United States Patent [19]

Svaty

[11] 4,068,686

[45] Jan. 17, 1978

[54] TECHNIQUE FOR CONTROLLABLY RECIPROCATING THE WEFT INSERTION PORTION OF A SHUTTLE-TYPE WEAVING LOOM

[75] Inventor: Vladimir Svaty, Liberec, Czechoslovakia

[73] Assignee: Elitex, koncern textilniho strojirenstvi, Liberec, Czechoslovakia

[21] Appl. No.: 718,793

[22] Filed: Aug. 30, 1976

[51] Int. Cl.[2] ..... D03D 47/24; D03D 49/34

[52] U.S. Cl. ..... 139/438; 139/144

[58] Field of Search ..... 139/437, 438, 439, 144; 60/473, 474, 475

[56] References Cited

U.S. PATENT DOCUMENTS

| | | | |
|---|---|---|---|
| 717,965 | 1/1903 | Blundell | 139/144 |
| 2,677,933 | 5/1954 | Hopkinson | 139/144 X |
| 3,330,305 | 7/1967 | Svaty et al. | 139/438 X |
| 3,722,552 | 3/1973 | Indra et al. | 139/144 |

FOREIGN PATENT DOCUMENTS

| | | | |
|---|---|---|---|
| 651,434 | 10/1928 | France | 139/144 |
| 888,485 | 5/1957 | United Kingdom | 139/144 |

*Primary Examiner*—James Kee Chi

[57] ABSTRACT

Facilities for controllingly reciprocating a hydraulically-actuated piston coupled to a gripper shuttle are described. A first hydraulic fluid reservoir and the cylinder housing the shuttle-engaging piston are disposed in a unitary, substantially closed housing pivotally supported on a rotatable shaft of the loom. Piston-actuating fluid is cyclically introduced rearwardly of the piston into an elastomeric reservoir disposed behind and coupled to a perforated rear wall of the cylinder. Fluid from the first reservoir in the housing is periodically transferred into the second reservoir to launch the shuttle. To effect the return stroke of the piston, fluid from the first reservoir is transferred to the front end of the cylinder in timed relation to the fluid transfer to the second reservoir. Facilities are provided for controllably removing fluid from the second reservoir prior to the return stroke of the piston, and for abruptly removing hydraulic fluid from the front end of the cylinder prior to the launching stroke of the piston.

10 Claims, 2 Drawing Figures

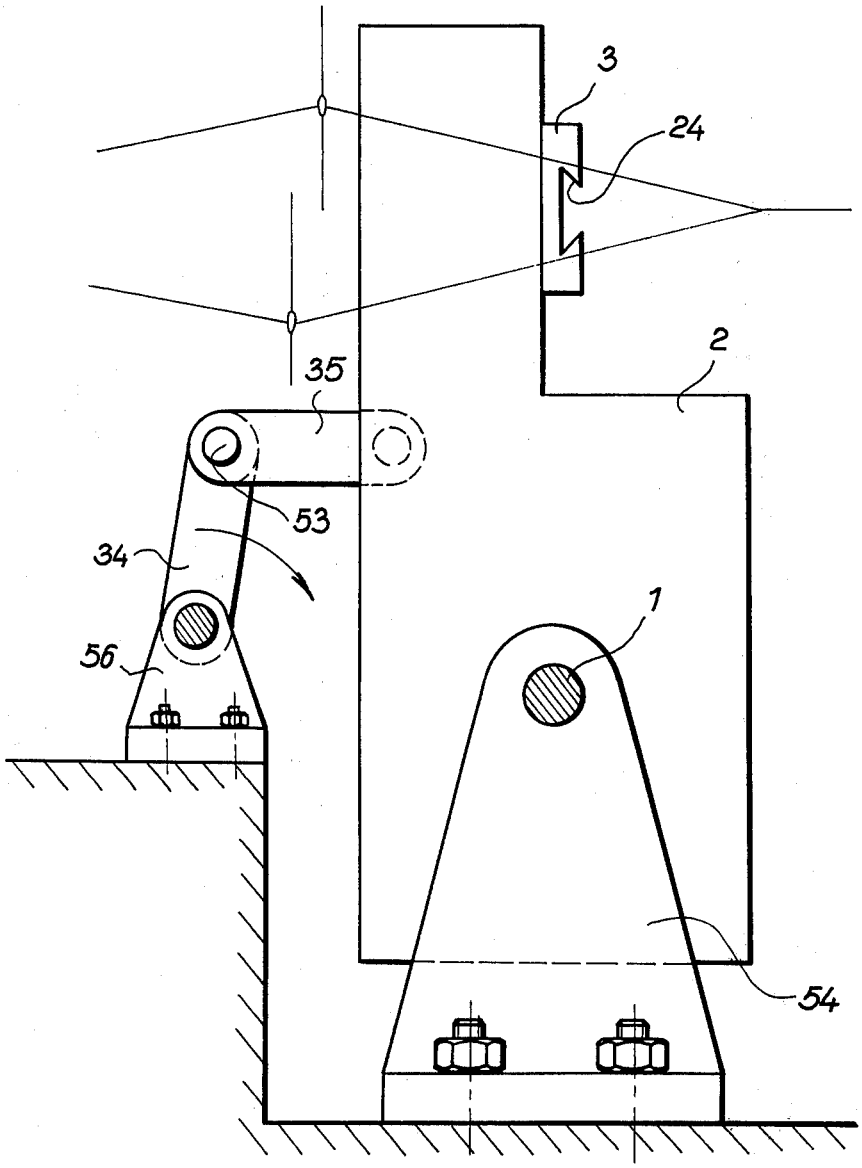
図-2

TECHNIQUE FOR CONTROLLABLY RECIPROCATING THE WEFT INSERTION PORTION OF A SHUTTLE-TYPE WEAVING LOOM

BACKGROUND OF THE INVENTION

The invention relates to weft insertion apparatus for shuttle-type weaving looms, and more particularly to arrangements for hydraulically actuating a cylinder-mounted piston coupled to the shuttle, with a forward motion of the piston from a rearmost position within its cylinder being effective to initiate a launch of the shuttle.

In known weft insertion facilities of this type, hydraulic fluid is introduced into the cylinder on both sides of the piston, with an excess hydraulic pressure being imposed on the rear side of the piston when the forward stroke thereof is to be initiated, and with an excess pressure being introduced on the forward side of the piston when the return stroke is to be effected. Such arrangement suffers from the disadvantage that the weight and resistance of the hydraulic fluid on the end of the piston opposed to the end at which the excess pressure is applied is considerable, and in fact is often greater than the load represented by the shuttle itself. Consequently, the launching arrangement must be of bulky and expensive heavy-duty construction.

In addition, in known arrangements of this type the cylinder in which the shuttle-launching piston is situated is mounted on a rotary underslay of the loom, while the reservoir for hydraulic fluid to be periodically introduced on both sides of the piston for the above-mentioned purposes is disposed on a fixed portion of the loom frame. Consequently, the conduits that transfer fluid from the reservoir to the cylinders must be of flexible and resilient construction in order to accommodate the relative motion of these parts, thereby adding to the complexity and expense of the unit. Moreover, the relative fragility of such flexible conduits, together with the fact that the movement of the piston exerts a tremendous compressive force on the hydraulic fluid disposed on the then-downstream portion of the piston, renders the facilities susceptible to severe hydraulic leakage problems.

SUMMARY OF THE INVENTION

Such disadvantages are overcome by the controlled piston actuation system of the present invention, which is adapted for shuttle-launching applications of the type discussed above. In an illustrative embodiment, both the hydraulic fluid reservoir and the cylinder which mounts the shuttle-engaging piston are disposed in a unitary, substantially closed housing, which in a typical case radially surrounds and is pivotally supported on a rotatable underslay shaft of the loom.

The shaft carries a plurality of eccentric elements for cyclically transferring hydraulic fluid from the reservoir at the bottom of the housing to points at the rear and forward ends, respectively, of the piston. In particular, a first one of the eccentric means reciprocates an auxiliary piston which propels fluid into the lower end of a rigid conduit, whose upper end is in communication with an elastomeric reservoir which is disposed behind a perforated rear wall of the cylinder. A second one of the eccentrics is associated with a second auxiliary piston which, during reciprocation thereof, propels fluid into the lower end of a second rigid conduit, which terminates at the forward end of the piston-supporting cylinder.

A normally closed valve is disposed in the front end of the cylinder rearwardly of the upper end of the second conduit means. The valve opening mechanism is coupled to a third eccentric on the shaft by means of a spring-loaded lever and a tie rod.

With this arrangement, after the conclusion of the forward shuttle-launching stroke of the piston, a withdrawal of fluid from the second reservoir behind the cylinder into the main reservoir in the bottom of the housing as the piston moves rearwardly permits the piston to move back into its rearmost position without having to overcome the resistance of hydraulic pressure at the rear of the piston. Similarly, after the piston has attained its rearmost position, the spatial relation of the eccentric means on the shaft will maintain the second reservoir free of fluid for a finite interval so that any malfunctions in the weaving loom have time to be detected prior to the initiation of the next shuttle launching stroke.

At the conclusion of the dwell interval, hydraulic fluid is re-introduced into the reservoir at the rear of the cylinder, and immediately thereafter the normally closed valve means at the front end of the cylinder is opened to abruptly discharge the hydraulic fluid forwardly of the piston. Thus, the next-succeeding forward stroke of the piston proceeds without resistance caused by hydraulic pressure in front of the piston. The forward pressure stroke is braked when the front end of the piston has advanced forwardly far enough to cover the opening in the cylinder wall exhibited when the valve means is switched into its open position.

BRIEF DESCRIPTION OF THE DRAWING

The invention is further set forth in the following detailed description taken in conjunction with the appended drawing, in which:

FIG. 2 is a side view, partially in schematic form, of an arrangement for pivotally supporting the piston-mounting housing of FIG. 1 for rotation about a principal underslay shaft of the weaving loom of FIG. 1.

DETAILED DESCRIPTION

Figure 1:
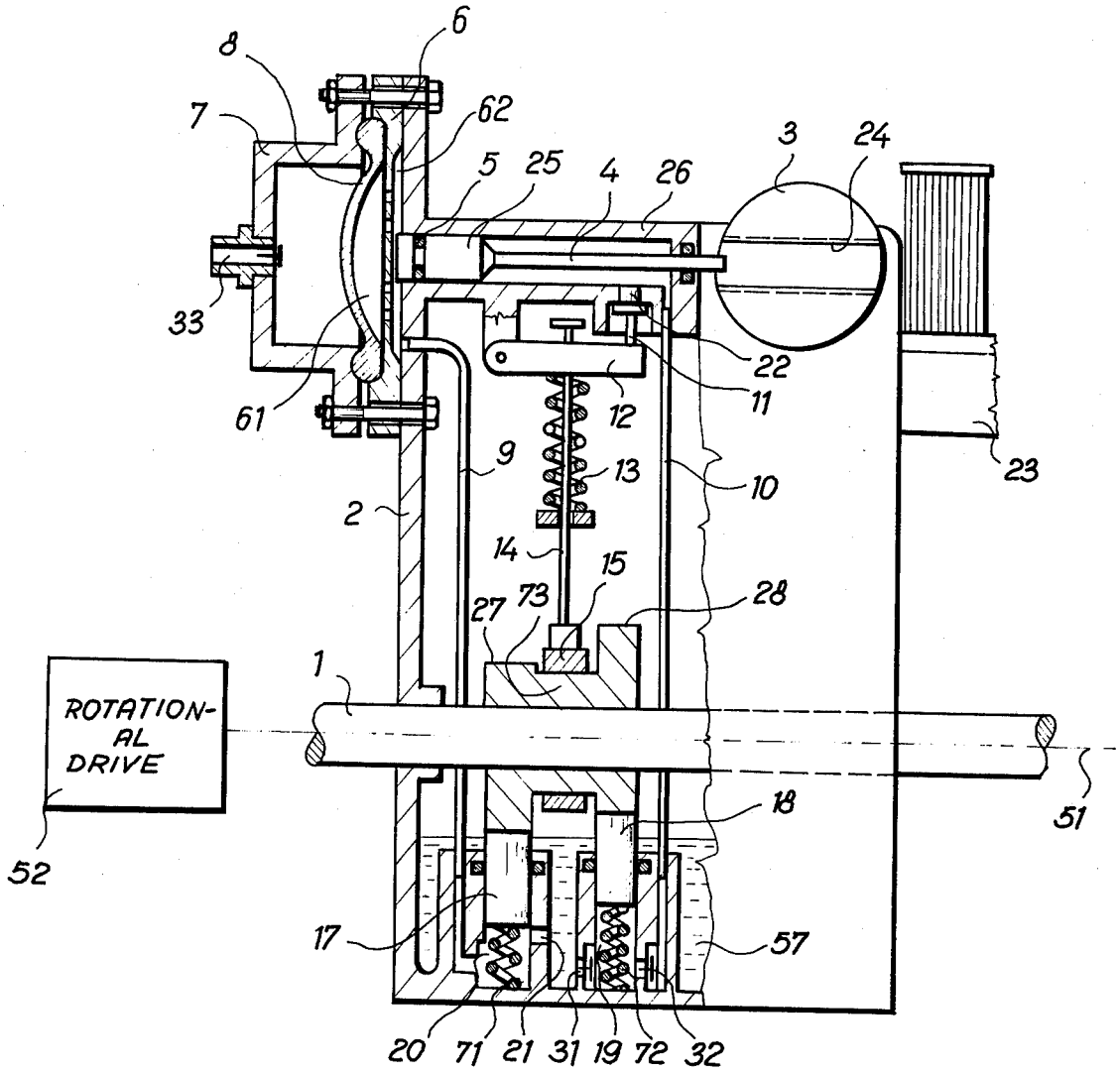
FIG. 1 is an elevation view, partially in section, of an arrangement for hydraulically actuating a shuttle-propelling piston in a weaving loom in accordance with the invention.

Referring now to the drawing, the numeral 1 represents a rotatable underslay shaft which is supported for rotation about a central axis 51 and which is rotatable in a first direction by means of a rotating drive 52.

The shaft 52 is provided with a plurality of cams (not shown) for controlling the motion of a conventional rotary gripper shuttle box 3 of a conventional weaving loom.

A slay 23 of the loom is affixed to a substantially closed housing 2, which is disposed in radially surrounding relation to the shaft 1. The housing 2, containing the elements described below, essentially takes the place of conventional slay swords associated with the slay 23 in looms of the indicated type.

As shown best in FIG. 2, the housing 2 is pivotally supported on the rotatable underslay shaft by means of a link system 34, 35 rotatably supported on an auxiliary shaft 53. As indicated, the main shaft 1 is supported on a trunion system 54, while the auxiliary shaft 53 is supported on a trunion system 56.

A hydraulic fluid reservoir 57 is disposed in the bottom of the housing 2. In the manner to be described, fluid from the reservoir 57 is cyclically transferred to the front and rear of a piston 25 which is slidably supported in a cylinder 26 disposed in the top of the housing 2 above the reservoir 57, such piston terminating in a forwardly extending piston rod 4 which extends in a conventional manner into a prismatic groove 24 (FIG. 2) in the shuttle box 3 to control the launching and return strokes of the associated gripper shuttle (not shown) in synchronism with the forward and rear motions, respectively, of the piston 25 within the cylinder 26.

The cylinder 26 is closed at its rear end by a perforated rear plate 6, against which the piston 25 abuts at the conclusion of its return stroke. The rear plate 6 is in turn bolted to a hermetically sealed, substantially U-shaped cover 7, which opens toward the plate 6. An elastic diaphragm 8 is clamped between the confronting ends of the cover 7 and the rear plate 6 to define an elastomeric rear boundary of a second reservoir 61, whose front boundary is constituted by the plate 6 itself.

With such arrangement, fluid introduced into the reservoir 61 in the manner described below will be effective to urge the piston 25 in a forward direction to initiate a launch of the shuttle.

In order to control the degree of expansion of the diaphragm 8 and thus regulate the quantity of fluid entering the reservoir 61 prior to each forward stroke, a pressure air inlet valve 33 is disposed in the rear wall of the lid 7 for effecting a one-time filling of the interior of the lid 7 with pressurized air or the like, such air filling constituting an effective limit stop on the expansion of the diaphragm 8. Once the pressurized air is introduced into the cover 7, the valve 33 can remain closed.

If desired, the front surface of the perforated rear plate 6 may be recessed as shown in its central region to define, with the rear wall of the housing 2, a gap 62. Thus, fluid introduced into the reservoir 61 may be applied to the rear of the piston 25 through the apertures in the rear plate 6 and the gap 62. Undesired flow of fluid axially along the length of the piston 25 in the annular space between its outer periphery and the inner wall of the cylinder 26 is prevented by means of a suitable sealing ring 5.

A radial opening 22 is provided in the front portion of the wall of the cylinder 26, such opening 22 being selectively blocked by means of a normally closed valve 11. The valve 11 is actuated by means of a lever 12, which may be pivoted against the force of a spring 13 upon a downward movement of a tie rod 14 that is coupled to the shaft 1 in the manner described below.

An integral eccentric unit 16 is affixed to the shaft 1 within the housing 2. A rear portion of the unit 16 is constituted by means of a first cam 27, against which an auxiliary piston 17 is urged as a follower by means of a spring 71 extending upward from the bottom of the reservoir 57. The piston 17 is disposed within a chamber 20, whereby a downward movement of the piston by virtue of a force applied by the cam 27 upon a rotation of the shaft 1 through a suitable angle will urge fluid from the reservoir 57 into the chamber 20 through an opening 31 in the wall of the chamber 20 and into the lower end of a conduit 9, which may be made of an inexpensive rigid material if desired. The upper end of the conduit 9 terminates in communication with the reservoir 61 behind the apertured rear plate 6 of the cylinder 26; in the particular arrangement shown in FIG. 1, the upper end of the conduit 9 confronts the gap 62.

A second cam 28 forms a front portion of the eccentric member 16 in axially spaced relation to the cam 27. A second auxiliary piston 18 is urged, by a spring 72, into engagement with the cam 28, such spring 72 extending upwardly from the bottom of the reservoir 57. The auxiliary piston 18 is reciprocable within a second chamber 19 in response to a rotation of the cam 28 and thereby of the shaft 1.

A suction valve 31 is provided in the wall of the chamber 19 for drawing hydraulic fluid from the reservoir 57 into the chamber 19 and through a discharge valve 32, whereby such hydraulic fluid can enter the lower end of a second conduit 10, which extends upwardly in the housing 2 and which, like the conduit 9, can be formed from an inexpensive rigid material, if desired.

A downward movement of the piston 18, via the urging of the cam 28 when the shaft 1 is rotated to a suitable angle, is effective to propel fluid introduced into the chamber 19 via the suction valve 31 into the lower end of the conduit 10 via the discharge valve 32. Conversely, an upward movement of the piston 18 under the force of the spring 72 will cause fluid to be withdrawn from the conduit 10 and into the reservoir 57 through the chamber 19 and the valve 31.

The upper end of the conduit 10 terminates at the front end of the cylinder 26, forwardly of the valve opening 22. Thus, when the piston 18 moves downwardly, fluid from the reservoir 57 may enter the space of the cylinder 26 forwardly of the piston 25 to effect a return stroke of the piston 25 at the conclusion of the launch of the shuttle within the box 3, such return movement being facilitated by the simultaneous removal of pressure on the rear side of the piston 25 in the manner to be described.

A central region 73 of the eccentric member 16 is secured to a disc 15, which in turn engages the lower end of the tie rod 14 for opening the valve 12.

The cams 27 and 28 and the eccentric middle region 73 of the member 16 are angularly arranged with respect to the periphery of the shaft 1 so that, in accordance with the invention, both the forward and return movements of the piston 25 can be effected with a minimal resistance of hydraulic pressure on the reverse side, thereby minimizing, for example, the danger of leakage. Thus, the cam 27 is so configured that the associated follower piston 17 is in its upper position exposing the opening 31 in the wall of the chamber 20 when the piston 25 is moving in a rearward direction, whereby the force of such moving piston 25 will be effective to propel fluid previously introduced into the reservoir 61 during the next-proceeding launching stroke downwardly through the conduit 9, the chamber 20 and the opening 21 into the reservoir 57. Such steady diminution of fluid in the reservoir 61 as the piston 25 moves rearwardly provides a yieldable load on the piston 25 until the latter has reached its rearmost position adjacent the front surface of the perforated rear plate 6. In addition, the angular relation of the cam 28 is so chosen that the auxiliary piston 18 is moved downwardly thereby to introduce fluid into the chamber 26 via the conduit 10 at the beginning of the return stroke of the piston. Finally, the position of the eccentric central portion 73 of the member 16 is so chosen relative to the positioning of the cams 27 and 28 that, after the required charge of fluid has been introduced into the reservoir 61

BEST AVAILABLE COPY by the action of the cam 27, the tie rod 14 is abruptly moved downward to actuate the piston 12 and thereby open the valve 11. Such opening will immediately relieve the pressure at the front end of the piston 25, so that the fluid charge in the reservoir 61 will permit the piston 25 to move forward abruptly and to thereby launch the gripper shuttle with a minimum of hydraulic resistance.

Thus, in operation, at the conclusion of each launch stroke with the piston 25 in its frontmost position, the rotation of the shaft 1 will cause the cam 28 to move the piston 18 downwardly to charge the front of the cylinder 26 and to thereby initiate the return stroke. During such stroke, fluid in the reservoir 61 is continually discharged through the conduit 9 and into the reservoir 57 until the piston has reached its rearmost position.

For a given dwell interval following the return of the piston 25, the contour of the cam 27 is maintained such that the piston 17 is at rest in its uppermost position shown, so that no fluid is introduced into the reservoir 61. During this interval, the piston 25 is maintained in its rest position, possibly with the further aid of suitable grippers (not shown). Any inadvertent forward movment of the piston 25 will be prevented by such auxiliary restrainers and/or the hydraulic pressure maintained by the fluid introduced into the cylinder 26 via the conduit 10. Thus, any malfunctions which have been detected by suitable means during the operation of the loom can be dealt with without danger of inadvertent renewed operation of the shuttle caused by a forward movement of the piston 25.

At the conclusion of the dwell interval, the continued rotation of the shaft 1 will cause the high point of the cam 27 to move the piston 17 downwardly against the spring 71, thereby propelling fluid upwardly through the conduit 9 and into the reservoir 61. As soon as a full propelling charge of fluid has entered the reservoir 61, the shaft 1 will have rotated into a position where the eccentric disc 15 in the middle of the member 16 will exert a downward force against the tie rod 14, thereby suddenly moving the lever 12 downwardly against the force of the spring 13 and abruptly opening the valve 11. The sudden release of hydraulic pressure at the front end of the cylinder 26 will cause the fluid in the reservoir 61 to suddenly propel the piston 25 forwardly to effect the next shuttle-launching stroke, such piston coming to rest in the forward end of the cylinder 26 with the periphery of the piston 25 re-closing the opening 22.

The cam 27 is preferably configured so that only approximately 90° of arc around the shaft 1 is present between the time that fluid is re-introduced into the reservoir 61 and the time that the valve 11 is opened to start the launch stroke, corresponding to the beginning of weft insertion in the loom. Such relatively small interval allows insufficient time, even under the worst conditions, for hydraulic pressure to build up around the piston 25 to a degree sufficient to cause leakage, thereby contributing to the "fail safe" operation of the system.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a hydraulically-actuated weft insertion apparatus for a weaving loom that includes a reciprocable shuttle movable in both forward and reverse directions along a first path by means of a single piston attached thereto, the apparatus comprising, in combination, a first reservoir, an elongated drive shaft, means for rotating the shaft about its axis, a working cylinder extending in the forward direction along the first path, means supporting the piston for reciprocation in the cylinder, and means coupling the first reservoir to the cylinder for launching the shuttle in the first direction when the piston is moved forwardly in the cylinder from a rearmost position thereof under the force of hydraulic fluid in the first reservoir, the improvement which comprises, in combination, a unitary, substantially closed housing radially surrounding a portion of the shaft, the housing having a lower end in which the first reservoir is situated and an open end in which the cylinder is disposed, a second reservoir supported adjacent the rear end of the cylinder and having front and rear ends, a perforated plate disposed in the housing adjacent the rear end of the cylinder for providing fluid communication between the front end of the second reservoir and the rear end of the cylinder, first means disposed in the housing and coupled to the shaft for transferring fluid between the first and second reservoirs in first timed relation to the shaft rotation, and second means disposed in the housing and coupled to the shaft for transferring fluid between the first reservoir and the front end of the cylinder in second timed relation to the shaft rotation to initiate a reverse movement of the shuttle along the first path.

2. Apparatus as defined in claim 1, in which the first fluid transferring means comprises, in combination, first conduit means having a lower end in communication with the first reservoir and an upper end in communication with the second reservoir, first eccentric means affixed to the shaft, first follower means normally urged against the first eccentric means and reciprocable by the first eccentric means as the shaft is rotated, and means for associating the first follower means with the lower end of the first conduit means for respectively propelling fluid into and withdrawing fluid from the lower end of the first conduit means.

3. Apparatus as defined in claim 2, in which the second fluid transferring means comprises, in combination, second conduit means having a lower end in communication with the first reservoir and an upper end in communication with the forward end of the cylinder, second eccentric means affixed to the shaft in axially spaced relation to the first eccentric means, second follower means normally urged against and reciprocable by the second eccentric means as the shaft is rotated, means for associating the second follower means with the lower end of the second conduit means for propelling fluid into the lower end of the second conduit means, normally closed valve means disposed in the forward portion of the cylinder rearwardly of the upper end of the second conduit means, and means including third eccentric means affixed to the shaft and dynamically coupled to the valve means for opening the valve means to empty fluid from the forward portion of the cylinder into the first reservoir.

4. Apparatus as defined in claim 3, in which the first, second and third eccentric means collectively define an integral structure.

5. Apparatus as defined in claim 1, in which the second reservoir defining means comprises, in combination, a substantially U-shaped cover opening toward and abutting the perforated plate, and an elastic diaphragm interposed between the cover and the perforated plate, the diaphragm forming the rear boundary of the second reservoir.

6. Apparatus as defined in claim 5, further comprising an inlet valve disposed in the wall of the cover exterior of the second reservoir for introducing pressurized fluid into the cover.

7. Apparatus as defined in claim 1, further comprising means for pivotally supporting the housing on the shaft.

8. Apparatus as defined in claim 3, in which the valve means comprises, in combination, a valve element positioned in the wall of the cylinder, spring means for normally urging the element into a closed position, and a lever connected to the valve element and actuable to move the element into an open position against the force of the spring means; and in which the third follower means comprises a tie rod interconnecting the third eccentric means with the lever for actuating the lever.

9. In a hydraulically actuated weft insertion apparatus for a weaving loom that includes a reciprocable shuttle, the apparatus comprising, in combination, a horizontally extending shaft, means for rotating the shaft about its axis, a unitary, substantially closed housing radially surrounding a portion of the shaft, the bottom of the housing having a first reservoir for hydraulic fluid, a working cylinder disposed and extending forwardly in the upper portion of the housing above the first reservoir, a perforated plate disposed in the housing adjacent the rear end of the cylinder, means associated with the housing and bounded forwardly by the perforated plate for defining a second reservoir for hydraulic fluid, a piston supported for reciprocation in the cylinder and coupled to the shuttle for launching the shuttle when the piston is moved forwardly in the cylinder from a rearmost position adjacent the rear end of the cylinder, normally closed valve means disposed in a forward portion of the working cylinder, first and second fixed conduit means extending upwardly within the housing, the first conduit means communicating at its lower end with a first portion of the first reservoir and at its upper end with the second reservoir, the second conduit means communicating at its lower end with a second portion of the first reservoir and at its upper end with the cylinder forwardly of the valve means, first and second eccentric means individually affixed to the shaft above the first and second portion of the first reservoir, first follower means engageable with the first eccentric means for propelling hydraulic fluid from the first reservoir into the second reservoir for transferring hydraulic fluid between the first and second reservoir through the first conduit means when the shaft is rotated, second follower means engageable with the second eccentric means for propelling fluid from the first reservoir into the front end of the cylinder through the second conduit means in timed relation to the fluid transfer in the first conduit means when the shaft is rotated, and means associated with the shaft within the housing and rendered effective in timed relation to the first and second follower means for opening the valve means to empty fluid out of the forward end of the cylinder and into the first reservoir.

10. In a method of hydraulically actuating a weft insertion arrangement for a shuttle-type weaving loom in which a cylinder-mounted, hydraulically actuated piston is coupled to the shuttle and reciprocated in forward and reverse directions, respectively, the launch of the shuttle being effected by a forward movement of the piston from its rearmost position, the forward movement of the piston being effected by the application of excess hydraulic pressure at the rear end of the piston and the return movement of the piston being effected by the application of excess hydraulic pressure on the forward end of the piston, the improvement which comprises the steps of controllably removing hydraulic pressure at the rear end of the piston after the piston has reached its frontmost position at the conclusion of shuttle launch, applying the excess hydraulic pressure to the forward end of the piston while pressure is removed from the rear end of the piston, re-introducing hydraulic pressure to the rear of the piston at the conclusion of a predetermined dwell time following the instant when the piston has reached its rearmost position while the above-mentioned hydraulic pressure is initially maintained at the front of the piston, and abruptly removing the hydraulic pressure from the front of the piston after such reintroduction of hydraulic pressure to the rear of the piston to initiate the next shuttle launch.

* * * * *